US005909000A

United States Patent [19]

Rakov

[11] Patent Number: 5,909,000

[45] Date of Patent: Jun. 1, 1999

[54] SYSTEM FOR SHOOTING USING COMPRESSED GAS

[76] Inventor: Mikhail A. Rakov, 1028 Marcussen Dr., Menlo Park, Calif. 94025

[21] Appl. No.: 08/806,298

[22] Filed: Feb. 26, 1997

Related U.S. Application Data

[63] Continuation-in-part of application No. 08/658,183, Jun. 4, 1996, Pat. No. 5,652,405.

[51] Int. Cl.[6] ..... F41F 1/00

[52] U.S. Cl. ..... 89/7; 89/1.34; 102/440; 124/57; 124/74

[58] Field of Search ..... 124/57, 73, 74, 124/75, 76, 77; 89/7, 1.34; 102/440, 464

[56] References Cited

U.S. PATENT DOCUMENTS

| | | | |
|---|---|---|---|
| 279,539 | 6/1883 | Chamberlain | 102/375 |
| 1,062,604 | 5/1913 | Pedersen | 102/464 |
| 1,985,184 | 12/1934 | Methlin . | |
| 2,375,314 | 5/1945 | Mills | 124/11 |
| 2,588,184 | 3/1952 | Walsh | 46/74 |
| 2,930,584 | 3/1960 | Hensley et al. | 33/745 |
| 2,964,031 | 12/1960 | Dotson | 42/1.14 |
| 3,102,525 | 9/1963 | Englis | 124/11 |
| 3,175,494 | 3/1965 | Turner | 102/38 |
| 3,313,208 | 4/1967 | Dorsey, Jr. et al. | 89/7 |
| 3,315,564 | 4/1967 | Hazlett, Jr. et al. | 124/77 |
| 3,369,609 | 2/1968 | Fogelgren | 169/31 |
| 3,417,719 | 12/1968 | Nitenson | 114/20 |
| 4,063,486 | 12/1977 | Ashley | 89/7 |
| 4,226,186 | 10/1980 | Peck | 102/464 |
| 4,328,632 | 5/1982 | Beers | 42/1 |
| 4,776,255 | 10/1988 | Smith | 89/1.13 |
| 4,843,750 | 7/1989 | Blase | 42/95 |
| 5,016,536 | 5/1991 | Brighton | 102/464 |
| 5,652,405 | 7/1997 | Rakov | 89/7 |

FOREIGN PATENT DOCUMENTS

| | | |
|---|---|---|
| 2034994 | 1/1972 | Germany . |

*Primary Examiner*—Stephen M. Johnson
*Attorney, Agent, or Firm*—Leo F. Costello

[57] ABSTRACT

A shooting system providing a barrel with an open forward end and a closed rear end and a projectile containing a propellant under pressure located in the barrel. A wad in the bore has a forward holding member allowing the rearward portion of the projectile to be moved rearwardly in the bore and be longitudinally slidably frictionally fitted in the holding member while the holding member is in sealing engagement circumferentially of and between the barrel and the projectile whereby the projectile is in a loaded state. The holding member also allows the projectile to move forwardly out of the holding member in the firing state. The wad also has a rearward sealing portion in circumferential sealing engagement with the barrel and radially spaced from the rearward portion of the projectile whereby the closed rearward end of the bore, the sealing member, and the projectile form a firing chamber. When the valve is actuated, propellant expands into the firing chamber where it is contained by the closed rearward end of the barrel and the sealing member and applies maximum pressure on the projectile to force it out of the holding member and the barrel thereby firing the projectile. An alternative embodiment provides a barrel with a longitudinally expandable goffered rear end portion forming part of the firing chamber whereby in the firing mode and upon release of the expanding propellant into the chamber, the propellant both expands the goffered section longitudinally and forces the projectile out of the barrel.

14 Claims, 7 Drawing Sheets

SYSTEM FOR SHOOTING USING COMPRESSED GAS

RELATED APPLICATIONS

This is a continuation-in-part of patent application Ser. No. 08/658,183 now U.S. Pat. No. 5,652,405 entitled "System for Shooting Using Compressed Gas" filed Jun. 4, 1996, by Mikhail A. Rakov, which is incorporated by reference in its entirety.

FIELD OF THE INVENTION

The present invention relates to accelerating objects using compressed gas, particularly gas contained in a cartridge comprising a thick-wall body and a membrane that are widely used in different areas of industry and house economy. This process of accelerating the objects can be broadly defined as a "shooting" and can be used for delivering objects in an emergency situation, extracting parachutes, and the like, as well as in real shooting.

BACKGROUND OF THE INVENTION

In a first type of shooting system, a cartridge with compressed gas, such as carbon dioxide, is used only as a source of energy for propelling the projectile. In such systems, the compressed gas is released to provide the energy source for acceleration of a separate projectile, such as a bullet, a pellet or the like. U.S. Pat. No. 2,375,314 (Mills) describes a device that uses a cartridge containing a compressed fluid for propelling a projectile. The compressed fluid is released from the cartridge and the pressure of the gas propels the projectile from the barrel. In this device, the cartridge remains in the device after launching of the projectile. The cartridge is held in place by a plate to prevent the cartridge from exiting the barrel during launching of the projectile. Annular gaskets are disposed on the outside of the projectile which, in turn, are snugly positioned within the barrel to contain the released fluid. Such a system does not use the cartridge as a projectile. In systems that use the cartridge only as a source of energy and not as a projectile, the problem of holding the cartridge in the barrel can be solved by bumps or dimples in the barrel as shown in Mills.

These shooting systems require high precision machining and molding for valves, pipes, mechanical parts, and projectiles. In addition, the material contained in the cartridge is not used in the process of shooting and is discarded after exhausting the gas contained in the cartridge.

In a second type of shooting system, a cartridge containing compressed gas is used both as a source of energy and as a part of the projectile. This system has difficulty holding the cartridge in a fixed position in a barrel prior to and during the moment of activation of the cartridge and then allowing the cartridge to move forward after activation. Second, the loss of gas between the bore of the barrel and the outside of the cartridge reduces the efficiency of the shooting system. U.S. Pat. No. 3,417,719 (Nitenson) describes an underwater gun in which a projectile is held in frictional engagement with the barrel by using a shank that holds the projectile in a frictional fit. A special shoulder of the cartridge overcomes the frictional force applied by the shank during activation of the projectile. The underwater gun of Nitenson requires strict dimensional tolerances of the cartridge and the bore of the barrel to reduce the release of gas during firing of the projectile.

U.S. Pat. No. 2,588,184 (Walsh) describes a system that uses inefficient rocket principles for compulsion and the outflowing of gases forbid the launching to occur from the hand of the operator because of the dangerous gases.

Using the cartridge only as a source of energy results in simpler constructions than the underwater guns described above for Nitenson, but these constructions are unusable when the cartridges are both a source of energy and a projectile because the cartridge moves forward after deactivation and the bumps prevent such movement of the cartridge. In fact, such movement of the cartridge is not intended by such systems and the cartridge is intended to be used only as an energy source.

A new approach to the method and devices for shooting using compressed gas is desired.

It is desirable to have a shooting system in which a cartridge containing the source of energy also functions as the projectile, and in such systems the use of the source of energy is increased by reducing the loss of resultant gases from exiting the barrel prior to disengagement of the projectile. It is also desirable to have a simple construction for a shooting system.

SUMMARY

A shooting system is provided including a barrel with an open forward end and a closed rear end and a projectile containing a propellant under pressure located in the barrel. A wad in the bore has a forward holding member allowing the rearward portion of the projectile to be moved rearwardly in the bore and be longitudinally slidably frictionally fitted in the holding member while the holding member is in sealing engagement circumferentially of and between the barrel and the projectile whereby the projectile is in a loaded state. The holding member also allows the projectile to move forwardly out of the holding member in the firing state. The wad also has a rearward sealing portion in circumferential sealing engagement with the barrel and radially spaced from the rearward portion of the projectile whereby the closed rearward end of the bore, the sealing member, and the projectile form a firing chamber. When the valve is actuated, propellant expands into the firing chamber where it is contained by the closed rearward end of the barrel and the sealing member and applies maximum pressure on the projectile to force it out of the holding member and the barrel thereby firing the projectile. An alternative embodiment provides a barrel with a longitudinally expandable goffered rear end portion forming part of the firing chamber whereby in the firing mode and upon release of the expanding propellant into the chamber, the propellant both expands the goffered section longitudinally and forces the projectile out of the barrel.

GENERAL DESCRIPTION OF THE PREFERRED EMBODIMENT

In the present invention, a cartridge containing a compressed gas is used both as a source of energy and as a projectile. The cartridge includes a valve on one end of the cartridge. The valve may be, for example, a membrane. The cartridge includes an annular wad that is disposed on an outer surface of the cartridge and towards the membrane. The cartridge is inserted into a bore of the barrel and the membrane is opened by piercing it with a striker, to thereby expire gas. The pressure of the expiring gas forces the cartridge together with the wad to move forward until reaching the end of the barrel. After exiting the barrel, further movement of the cartridge as a projectile continues by the force of inertia.

The wad forms a hermetic seal between the projectile and the barrel. The wad has a holding part and a sealing part. The holding part is mounted to an outer surface on a rear end of the projectile for frictionally engaging the bore of the barrel before enduring actuation of the valve. The sealing part engages the bore of the barrel during the release of the fluid to contain the released fluid in the formed chamber which is formed by the sealing part, the rear end of the projectile and the barrel. As the fluid is released into the chamber, the pressure of the fluid urges the sealing part into contact with the bore of the barrel to thereby form a hermetic seal between the projectile and the barrel. The opening may include urging the striker to open the valve. The valve of the projectile may be a membrane, and the urging of the striker step includes piercing the membrane.

A shooting system shoots a projectile, which stores a compressible fluid in a compressed state and has a valve mounted in a rear end of the projectile. A longitudinal barrel has an opening on a front end and has a cap on a rear end. The projectile is frictionally movable within the barrel. A striker is disposed in the cap for opening the valve of the projectile to release said fluid into a chamber to urge the projectile toward the opening of the barrel as the fluid is released. The rear end of the projectile, the barrel, and the cap form the chamber.

The projectile has a wad that forms a hermetic seal between the projectile and the barrel to substantially contain the released fluid in the chamber until the projectile exits the opening of the barrel. The wad also provides frictional engagement between the projectile and the bore of the barrel before enduring actuation of the valve in order to hold the projectile in place during said actuation. As the released fluid fills the chamber, the pressure of the gas urges the projectile forward. The wad has a sufficiently low coefficient of dynamic friction so that the projectile is movable within the bore of the barrel. The barrel and the striker may be formed of a disposable material. The flight of the projectile may be stabilized. An inner surface of the barrel may be rifled. A load may be detachably mounted to the front end of the barrel and may include a plurality of stabilizers.

The present invention provides a shooting system that includes a barrel and a projectile. The barrel has a wall and an opening on one end. The wall has a gofferred shape in a first state and has a tubular shape over first length in a second state. The projectile is detachably mounted to the opening of the barrel. The projectile provides gas to urge the barrel from the first state to the second state and to further urge the projectile to disengage after the second state of the barrel and to move forward in response to inertia and to the providing of the gas.

The method of shooting and the shooting system allow the projectile to be moved more simply with less moving parts and without high precision parts.

DETAILED DESCRIPTION OF THE PREFERRED EMBODIMENT

Figure 1:
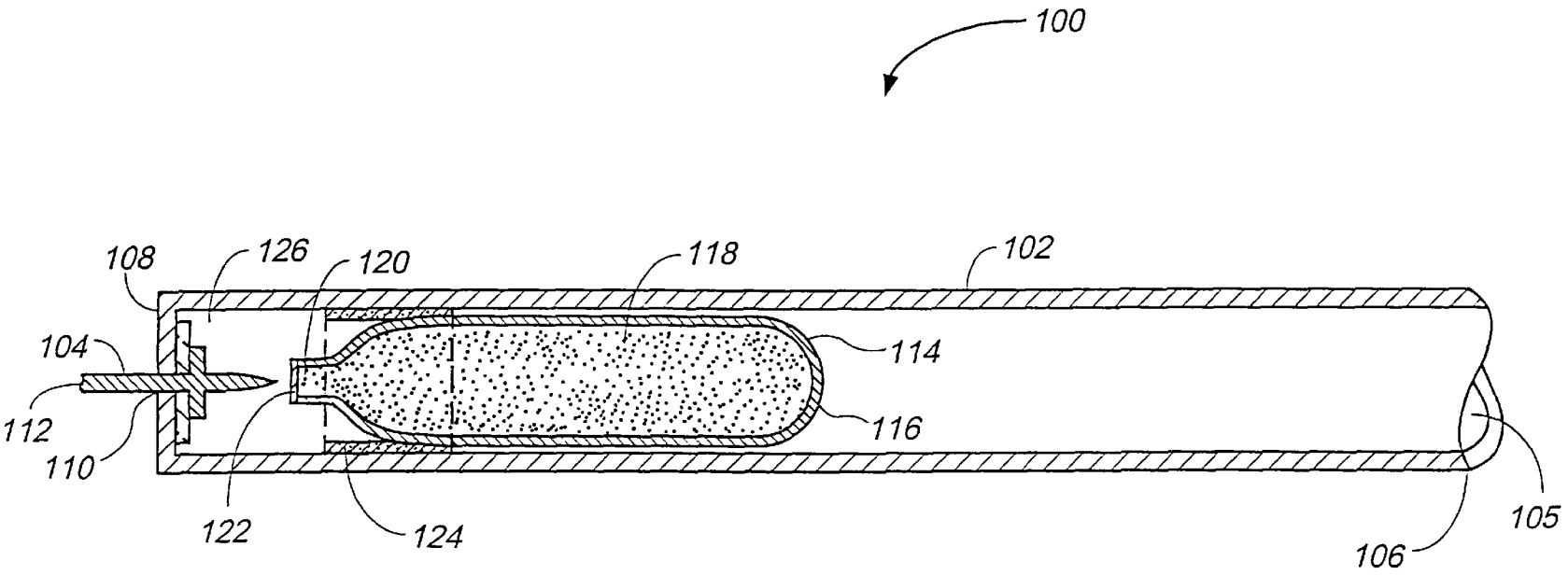
FIG. 1 is a longitudinal cross sectional view illustrating a shooting system in accordance with the present invention.

Referring to the FIG. 1, there is shown a longitudinal cross-sectional view illustrating a shooting system 100, which includes a barrel 102 and a striker 104. The barrel 102 has a constant uniform transverse cross-section, which is preferably circular. The barrel 102 includes a bore 105 disposed along a longitudinal axis of the barrel 102. A front end of the bore 105 forms an opening 106. The barrel 102 includes an end cap 108 on a rear end of the bore 105. The end cap 108 hermetically seals the rear end of the barrel 102. The barrel 102 is formed of a rigid material, such as aluminum or a rigid plastic.

The striker 104 is disposed through a hole 110 in the end cap 108. The striker 104 and the strikers described below are activators of the propellant in the projectiles. A hermetic seal around the hole 110 in the end cap 108 prevents gases from passing through the hole 110. A rear end 112 of the striker 104, which is external to the barrel 102, couples to a trigger mechanism (not shown). The trigger mechanism preferably includes a spring to return the striker 104 to an initial position after being urged into the barrel 102. For simplicity, the trigger mechanism for actuating the striker 104 is not shown. The shooting system 100 may be mounted to a stock, as in a conventional rifle, or to a pistol grip. The striker 104 may be coupled to a conventional trigger. Alternatively, a finger grip may be coupled to the rear end of the barrel 102 so that when the user holds the shooting system 100 the striker 104 engages the palm of the hand. The user curls his fingers to urge the striker 104 into the palm of the hand to discharge a projectile 114 positioned in the barrel 102.

The projectile 114 includes a housing 116 having a fluid containment chamber 118 therein with an opening 120 on a rear end of the housing 116. A valve 122 is mounted across the opening 120 of the projectile 114. The valve 122 may be, for example, a thin membrane. The fluid containment chamber 118 stores a compressible fluid in a compressed state. The fluid may be, for example, carbon dioxide. The projectile 114 releases the fluid when the valve 122 is opened. For a valve 122 that is a membrane, the membrane typically is pierced to release the fluid.

The projectile 114 includes an annular wad 124 disposed on the outer surface of the housing 116. When the projectile 114 is in the barrel 102, the wad 124 engages both the barrel 102 and the projectile 114 to form a chamber 126 between the barrel 102, the end cap 108, and the projectile 114. The wad 124 forms a hermetic seal to substantially prevent the flow of gas from the chamber 126 through a windage between the inner surface of the barrel 102 and the projectile 114.

The wad 124 can be integral with the housing 116. The wad 124 provides hermetization between the projectile 114 and the barrel 102. In an embodiment in which the outer diameter of the projectile 114 closely matches the inner diameter of the bore 105, the projectile 114 need not include the wad 124. In such an embodiment, the cartridge itself provides a simplified projectile.

Figure 1A:
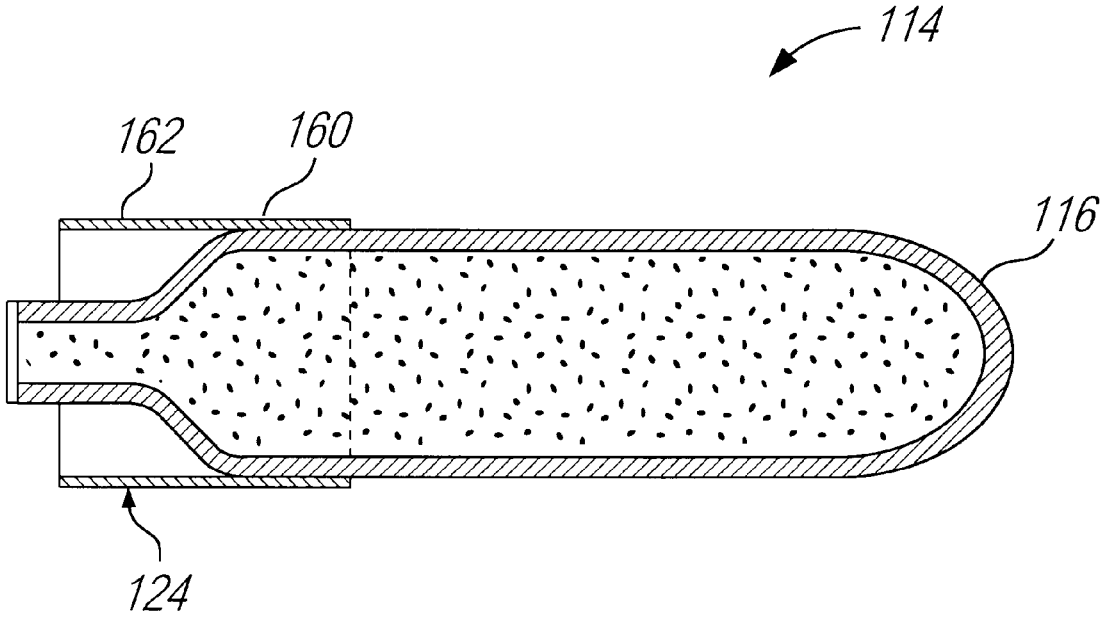
FIG. 1*a* is a longitudinal cross sectional view illustrating a projectile of the shooting system of FIG. 1.

Referring to FIG. 1*a*, there is shown a longitudinal cross sectional view illustrating the projectile 114 in accordance with the present invention. The wad 124 includes a holding part 160 and a sealing part 162. The holding part 160 is disposed on the outside surface of the housing 116 at the rear end of the housing 116. In one embodiment of the present invention, the holding part 160 is annularly shaped. The sealing part 162 is on the rear of the wad 124 and engages the housing 116 at a front end of the sealing part 162. The wad 124 preferably is formed of an elastic material. The sealing part 162 preferably has sufficient rigidity so that, when the projectile 114 is inserted into the barrel 102, the sealing part 162 does not fold back as the projectile 114 is urged towards the rear of the barrel 102 towards the striker 104. The holding part 160 is in frictional engagement with the bore 105 when the projectile 114 is mounted in the bore 105. The wad 124 preferably has a sufficient coefficient of static friction so that the projectile 114 is not moved before and during the activation of the projectile 114, and has a sufficient coefficient of dynamic friction so that, as the gas discharges, the projectile 114 moves forward within the barrel 102. As the gas is released from the housing 116, the chamber 126 is filled with the gas and the expanding gas urges the sealing part 162 outward from a central longitudinal axis of the projectile 114 to engage the inner surface of the bore 105 to thereby provide sealing of the chamber 126 through hermetization between the projectile 114 and the barrel 102. In systems using such a wad 124, the barrel 102 may be rigid and the inner diameter of the barrel 102 and the outer diameter of the projectile 114 need not be tightly controlled.

Figure 2:
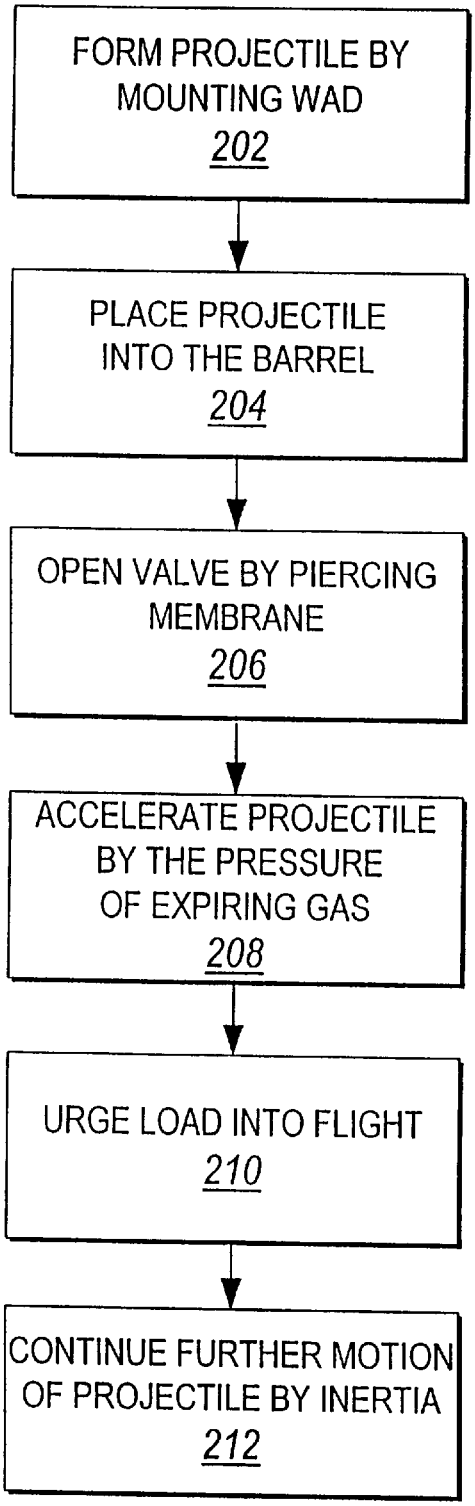
FIG. 2 is a flowchart illustrating the sequence of operations in the proposed method.

Referring to the FIG. 2, there is shown a flowchart illustrating the sequence of operations of the method of shooting in accordance with the present invention. The projectile 114 is formed 202 by mounting the wad 124 on the outer surface of the housing 116. Of course, in some embodiments such as described below in conjunction with FIGS. 3–7, the forming 202 may be skipped. The projectile 114 is placed 204 into the bore 105 of the barrel 102 with the valve end of the projectile 114 being positioned adjacent the striker 104. The shooting system 100 is now initialized for firing.

The striker 104 is actuated and urged into contact with the valve 122 of the projectile 114 to open 206 the valve. For a valve 122 that is a membrane, the striker 104 pierces the membrane and then withdraws from the hole in the membrane to thereby release the compressed gas. The gas exhausts from the fluid containment chamber 118 of the projectile 114 into the chamber 126 and fills the chamber 126 to thereby pressurize the chamber 126.

The pressure P of this gas interacts with the projectile 114 to produce a linear force F which is proportional to the pressure P and the area S of the back end of the projectile 114:

$$F=P\times S \tag{1}$$

The parameters of the expiring gas obey to the law of Charles and Gay-Lussac:

$$P\times V=n\ R\ T \tag{2}$$

where P is the pressure of the gas in the chamber 126, V is the volume of the chamber 126, n is the number of moles of the gas, and R is a constant for a specific gas.

As the gas discharges into the chamber 126, the force from the pressurized gas in the chamber 126 accelerates 208 the projectile 114 in accordance with Newton's second law of motion:

$$a=k\times F/m \tag{3}$$

where a is the acceleration of the projectile, F is the force acting on the projectile 114, m is the mass of the projectile 114, and k is a proportionality constant, which depends on the units selected for the acceleration a, the force F, and the mass m.

At the front end of the barrel 102, the projectile 114 has an exit velocity v defined by the equation:

$$v=a\times t \tag{4}$$

where t is the time of exhausting the compressed gas from the projectile 114. The projectile 114 may engage a useful load, described below, and urge 210 such load into flight. After exiting the barrel 102, further motion 212 of the projectile 114 is due to the law of inertia. This description of the process is somewhat simplified. Of course, the pressure varies in time and the velocity is a time integral of the acceleration of equation (3) using equations (1) and (2) to define the force F acting on the projectile 114 from the pressurized gas. However, the velocity defined by equation (4) may provide satisfactory qualitative as well as quantitative results.

The method and system of the present invention provides simpler shooting than conventional air guns. The shooting system 100 does not require gas pipes or high precision parts. The only moving part is the striker 104. The projectile 114 and the barrel 102 form a hermetic seal. In contrast, conventional compressed gas shooting systems require higher precision parts.

The gas-containing cartridge itself is used as a projectile, so its material is not wasted. The shooting system 100 does not require special high-precision bullets, pellets, or the like. The projectile 114 may be, for example, inexpensive conventional compressed gas cartridges, such as cartridges with compressed carbon dioxide ($CO_2$) or other compressed gases.

The flight of the projectile 114 may be stabilized using conventional methods. For example, the stabilization may be accomplished by a gyroscopic effect by rotating of the projectile 114 along rifling along the surface of the bore 105. Alternatively, mechanical stabilizers, such as stabilizing fins, may be mounted on the rear part of the projectile 114. Such fins may be attached to the annular wad 126 and open after the projectile 114 exits the barrel 102. Alternatively, the stabilizing fins can be placed on the outlet of the barrel 102 and moved from the barrel 102 by the projectile 114 after exiting the bore 105.

Figure 3:
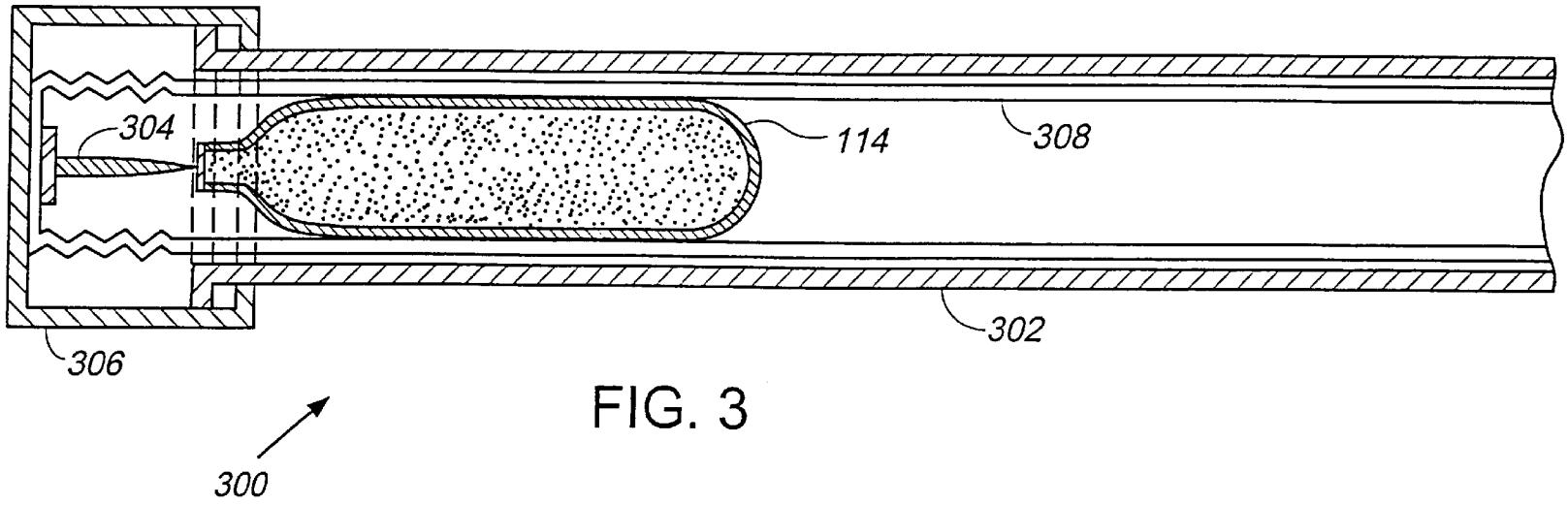
FIGS. 3 and 4 are longitudinal cross sectional views illustrating a loaded state and a state of shooting, respectively, of another shooting system in accordance with the present invention.
Figure 4:
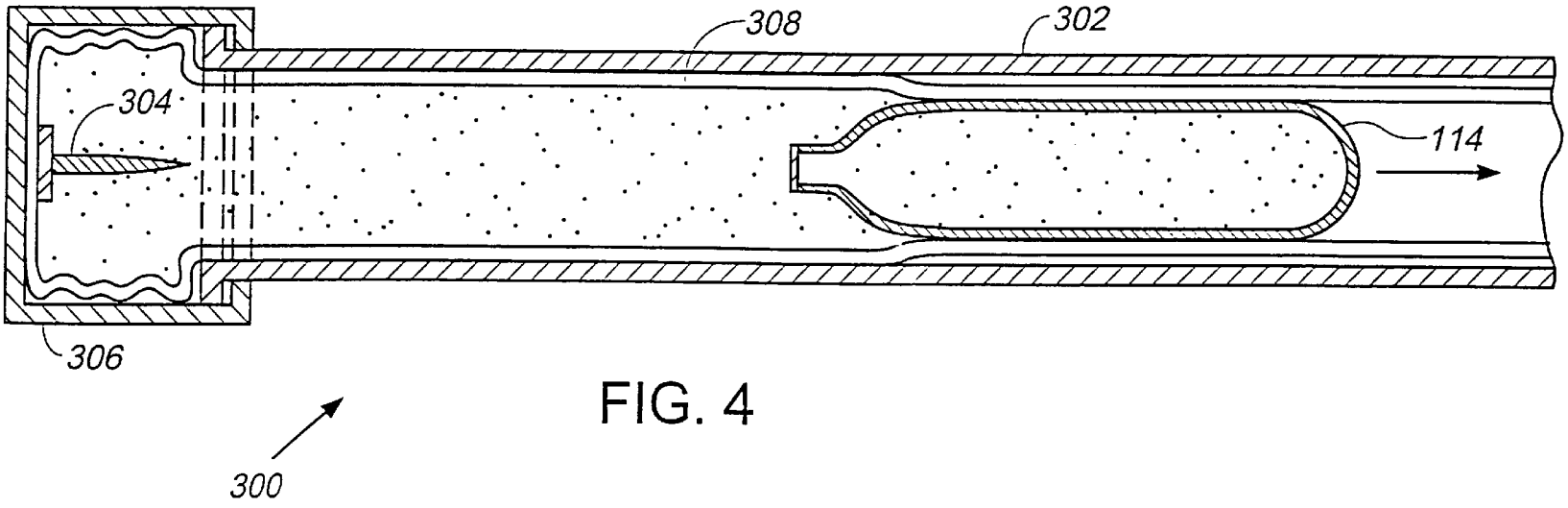

Referring to FIGS. 3 and 4, there are shown longitudinal cross-sectional views illustrating a loaded state and a shooting state, respectively, of a shooting system 300 in a second embodiment of the present invention. The shooting system 300 includes a barrel 302, a striker 304, an end cap 306, and inner tube 308. The shooting system 300 reduces the mechanical problem of precisely matching diameters of the barrel 302 which can be formed as a combination of hard outer and elastic inner pipes. The diameter of the inner pipe allows the projectile to be inserted therein with certain friction.

The end cap 306 is mounted to a rear end of the barrel 302. The inner dimensions of the end cap 306 may be larger than the outer dimensions of the barrel 302. The inner tube 308 has one end mounted to the inner wall of the end cap 306 and has an open end at the end of the barrel 302 opposite the end cap 306. The inner tube 308 is disposed along the inner surface of the barrel 302 to form a channel for the projectile 114 as it moves through the barrel 302. The inner tube 308 forms a hermetic seal with the projectile 114.

The striker 304 is disposed in the end cap 306 and in a back crimped end of the inner tube 308 to open the valve 122 of the projectile 114. After the striker 304 pierces the membrane and the gases expire from the projectile 114, hermetization is achieved between the projectile 114 and the barrel 302 even without special wad and without difficult requirements of precise dimensions. While the inner elastic tube 308 ensures hermetization, the outer rigid barrel 302 limits expansion of the inner tube 308 as shown in FIG. 4. These functions can be combined into an integral barrel with the properties of limited expansion. The resulting device, having a simple construction, can be called a "disposable gun". In such a device, the barrel 302 may be formed of plastic, such as polyvinyl chloride, and the tube 308 may be formed of a rubber material. The "disposable gun" may be simple and inexpensive, such as the shooting system of FIGS. 5–7.

Figure 5:
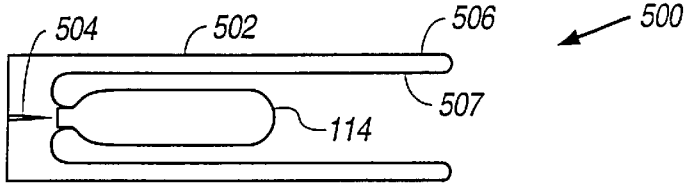
FIGS. 5, 6, and 7 are longitudinal cross-sectional views illustrating a loaded state, and first and second shooting states, respectively, of a shooting system in a third embodiment of the present invention.
Figure 6:
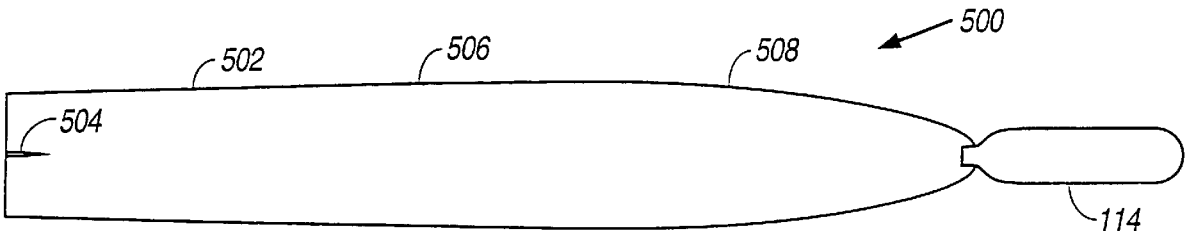
Figure 7:
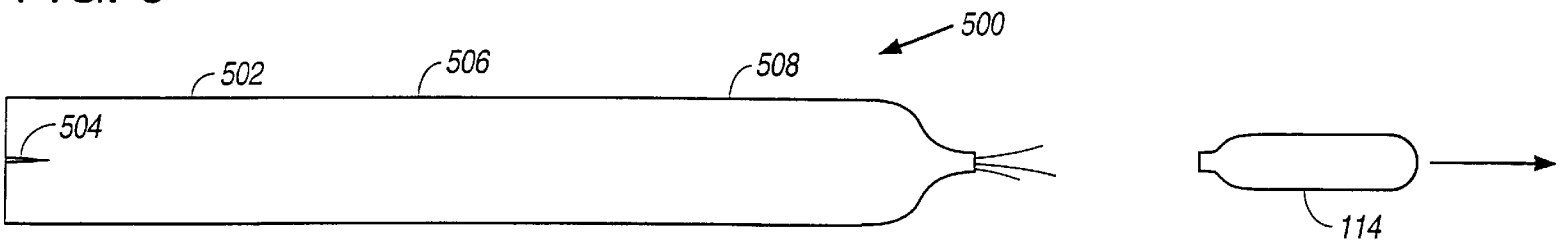

Referring to FIGS. 5, 6, and 7, there are shown longitudinal cross-sectional views illustrating a loaded state, and first and second shooting states, respectively, of a shooting system 500 in a third embodiment of the present invention. The shooting system 500 includes a barrel 502 and a striker 504. The barrel 502 includes a semi-rigid portion 506 and a flexible portion 508 having a first end mounted to a front end of the semi-rigid portion 506. The semi-rigid portion 506 and the flexible portion 508 may be formed of the same material and the rigidity or flexibility of such portions may be determined by the thickness of the wall of the portions, by the addition of ribs, or the like. The rear part of the barrel 502 may be crimped in a manner similar to that of the system 300 of FIGS. 3–4. The flexible portion 508 initially is in a bore of the semi-rigid portion 506.

The projectile 114 engages a second end of the flexible portion 508 with the valve 122 of the projectile 114 positioned near the striker 104 for engaging the striker 104 after actuation of the striker 104. The projectile 114 forms a hermetic seal between the projectile 114 and the second end of the flexible portion 508 of the barrel 502 to substantially contain the released fluid in the chamber until the projectile 114 disengages from the flexible portion 508. After the valve 122 is opened, the expanding gas urges the projectile 114 and the flexible portion 508 along the longitudinal axis of the barrel 502 to fully extend the flexible portion 508 as shown in FIG. 6. Referring now to FIG. 7, after the projectile 114 disengages from the flexible portion 508, the motion of the projectile 114 is due to inertia.

Figure 8A:
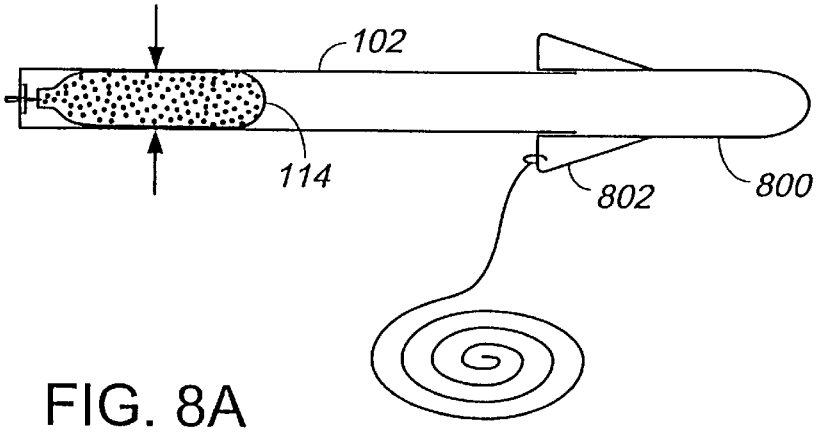
FIGS. 8*a*, 8*b*, and 8*c* are longitudinal cross-sectional views illustrating a shooting system for moving a load.
Figure 8B:
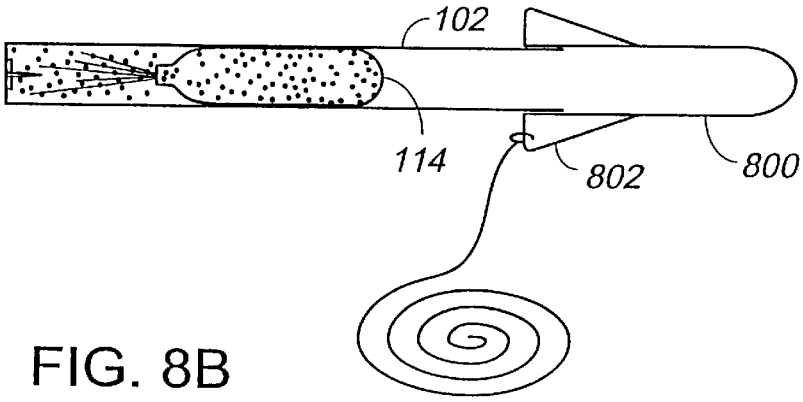
Figure 8C:
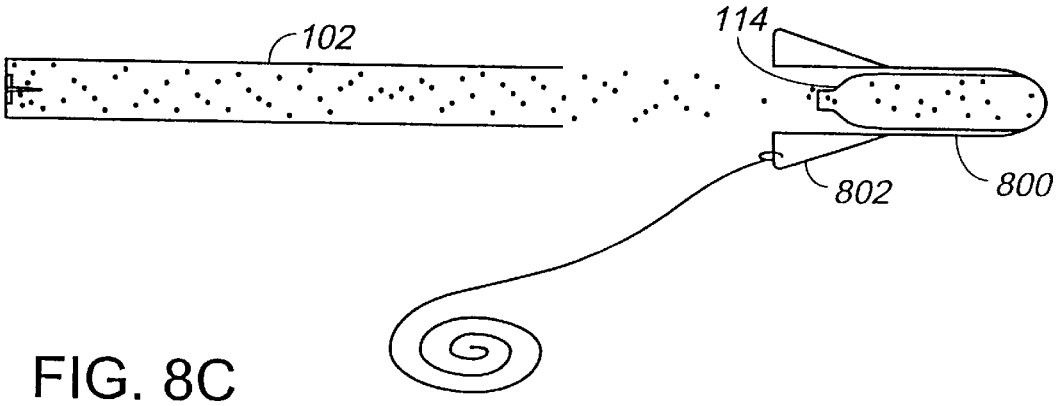

Referring to FIGS. 8*a*, 8*b*, and 8*c*, there are shown longitudinal cross-sectional views illustrating the shooting system 100 used for moving a load 800. The load 800 is detachably mounted to the front end of the barrel 102. The load 800 may include a plurality of stabilizers 802. The projectile 114 may carry the load 800, which may be, for example, an attached rope, a soft or sharp head, a device for producing sound, and the like. In addition, the method and the system of the present invention may be used in rescue operations by delivering ropes or flotation devices, or for extracting objects in an emergency, such as parachutes. Other uses include personal protection against attackers, riot rifles, or rifles for temporarily immobilizing animals. A simple and inexpensive disposable gun may be used as a part of standard equipment for law enforcement personnel.

Figure 9A:
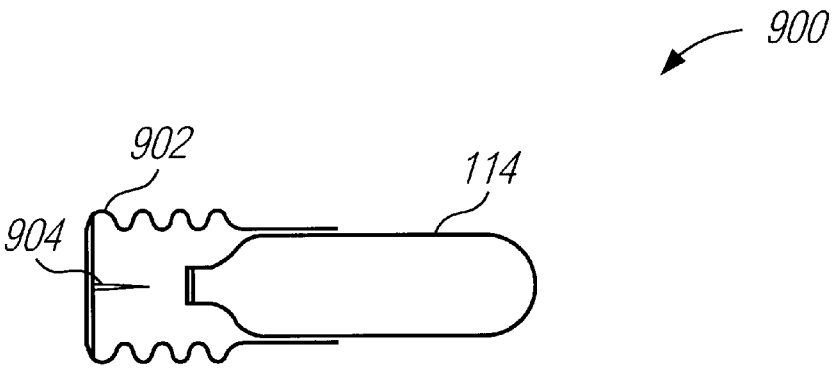
FIG. 9*a*, 9*b*, and 9*c* are longitudinal cross sectional views illustrating a shooting system in an initial loaded state, a shooting state after activation of a gas propellant, and a shooting state after the projectile disengages the barrel, respectively, in accordance with a sixth embodiment of the present invention.
Figure 9B:
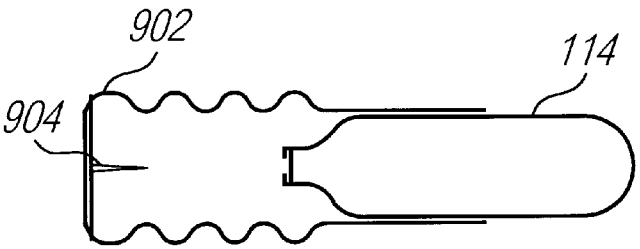
Figure 9C:
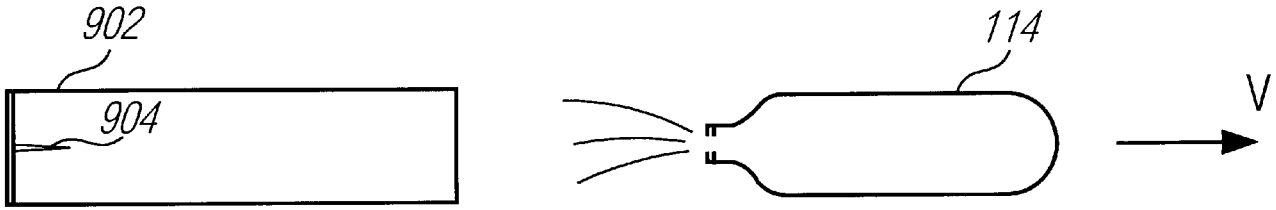

Referring to FIG. 9*a*, 9*b*, and 9*c*, there are shown longitudinal cross sectional views of a shooting system 900 in an initial loaded state, a shooting state after activation of a gas propellant, and a shooting state after the projectile 114 disengages a barrel, respectively, in accordance with a sixth embodiment of the present invention. The shooting system 900 includes a barrel 902, a striker 904, and a projectile 114. The barrel 902 is preferably formed of an elastic material. The barrel 902 has a gofferred shape in an initial state. The projectile 114 is detachably mounted to an opening of the barrel 902. In one embodiment of the present invention, the projectile 114 is a cartridge containing a compressible fluid. The barrel 902 may be mounted to a support (not shown). The projectile 114 preferably is formed as a gas filled cartridge containing a compressible gas propellant. The barrel 902 contains the released gas until the projectile 114 disengages the gofferred barrel 902. In one embodiment of the present invention, the hand of an operator of the shooting system 900 may function as the support.

After activation of the propellant, such as opening a valve to release gas from the projectile 114, the expanding gas causes the barrel 902 to expand to thereby urge the projectile 114 forward. After the barrel 902 is fully expanded as shown in FIG. 9*b*, the projectile 114 disengages the barrel 902 and further motion of the projectile 114 is due to inertia, and to gas exhausting from the valve 122 formed in the rear end of the projectile 114 as shown in FIG. 9*c*.

I claim:

1. A shooting system comprising:

a barrel having an elongated bore with an open forward end and a closed rearward portion spaced from the forward end;

a projectile having forward and rearward portions and containing a propellant under pressure, the projectile being located in the bore of the barrel with its rearward portion adjacent to rearward portion of the bore;

a wad in the bore having forward holding means that allows the rearward portion of the projectile to be moved rearwardly in the bore and be longitudinally slidably frictionally fitted in the holding means while the holding means is in fluid-tight sealing engagement circumferentially of and between the barrel and the projectile whereby the projectile is in a loaded state, said holding means also allowing the projectile to move forwardly out of the holding means incident to the application of pressure longitudinally forwardly of the bore on the rearward portion of the projectile during firing of the projectile, the wad also having a rearward sealing means projecting rearwardly from the holding means in circumferential fluid-tight sealing engagement with the barrel and radially spaced from the rearward portion of the projectile whereby the closed rearward portion of the bore, the sealing means, and the projectile form a hermetically sealed firing chamber; and means for releasing the propellant into the firing chamber where it is contained and applies pressure on the rearward portion of the projectile to force the projectile forwardly in the bore out of the holding means and out of the barrel thereby firing the projectile.

2. The shooting system of claim 1, wherein the releasing means includes a valve in the rearward portion of the projectile and a striker in the rearward portion of the barrel capable of opening the valve in order to fire the projectile.

3. The shooting system of claim 1, wherein the projectile has an outside uniform diameter where it is engaged by the wad; and wherein the wad is annular and has a uniform inside diameter throughout its length from the holding means to the sealing means whereby the projectile can slide both rearwardly and forwardly in and relative to the wad.

4. The shooting system of claim 1, wherein the projectile has a smooth outside surface where it is engaged by the wad; and wherein the wad is annular and has a smooth inside surface whereby the projectile can slide both rearwardly and forwardly in and relative to the wad.

5. The shooting system of claim 1, wherein the wad is a sleeve;

wherein the holding and sealing means are front and rear sections of the sleeve;

wherein the sleeve has a uniform inside diameter from the front section to the rear section; and wherein the projectile has a uniform outside diameter from the rearward portion thereof forwardly throughout the area thereof where the projectile engages the sleeve, said inside and outside diameters being approximately the same so that the projectile is tightly but forwardly and rearwardly slidably fitted in the sleeve.

6. The shooting system of claim 5, wherein the bore has uniform diameter between its forward end and closed rearward portion;

wherein the sleeve has a uniform outside diameter; and wherein the outside diameter of the sleeve and the diameter of the bore are approximately the same whereby the sleeve is fitted in the bore in fluid-tight relation therewith.

7. The shooting system of claim 6, wherein the sleeve is of elastic material; and wherein during firing of the projectile, the rear section of the sleeve is forced radially outwardly against the barrel by the expanding propellant around the rearward portion of the projectile thereby forcing the rear section into further fluid-tight relation with the barrel.

8. The shooting system of claim 7, wherein the rearward portion of the projectile is in the firing chamber and is tapered; and wherein the tapered rearward portion is radially spaced from the rear section of the sleeve.

9. The shooting system of claim 8, wherein the releasing means includes a membrane valve in the rearward tapered portion of the projectile and a striker in the closed portion of the barrel that is aligned with the valve so that upon forward movement of the striker in the barrel, the striker pierces the valve to open the same.

10. The shooting system of claim 1, wherein the holding means holds the projectile in circumferentially spaced relation to the barrel forwardly of the holding means.

11. A shooting apparatus comprising:

a barrel having an elongated bore circumscribed by an annular internal surface and having opposite longitudinally spaced rearward and forward ends, the barrel being open at its forward end but having an end wall closing its rearward end;

an annular wad concentrically fitted in the bore adjacent to the rearward end and having an annular outer surface in fluid-tight engagement with the internal surface and an annular inner surface, the wad also having a forward holding section and a rearward sealing section;

a projectile containing a compressed gaseous propellant and having a rear end portion providing a valve having a normally closed position to contain the propellant and an open position to release the propellant for firing the projectile, the projectile being longitudinally movable in the bore in a loaded position of the projectile with the rear end portion of the projectile rearwardly slidably frictionally received in the holding section but being longitudinally forwardly movably in the bore relative to the wad during firing of the projectile, the sealing section of the wad projecting rearwardly from the holding section in circumferential fluid-tight engagement with the internal surface of the bore and in radially spaced circumscribing relation to the rear end portion of the projectile in said loaded position, thereby forming a firing chamber between the end wall, the internal surface, the sealing section, and the projectile and so that the valve can release the propellant into the firing chamber when the valve is opened; and a striker for opening the valve to release expanding propellant into the firing chamber, whereby the expanding propellant urges the sealing section against said internal surface to prevent the expanding propellant from escaping between the barrel and the projectile thereby allowing the expanding propellant to exert maximum pressure on the rearward portion of the projectile and eject it out of the wad and the barrel.

12. The shooting system of claim 11, wherein the wad is a sleeve of elastic material having a uniform outside diameter throughout its length approximately the same as the inside diameter of the bore of the barrel and a uniform inside diameter throughout its length approximately the same as the outside diameter of the projectile so as to fit in fluid-tight relation in the bore and in fluid-tight relation around the projectile while allowing the projectile to move longitudinally of the bore outwardly of the sleeve when the projectile is fired.

13. The shooting system of claim 11, wherein the striker is movably mounted in the end wall in alignment with the valve.

14. The shooting system of claim 11, wherein the holding section holds the projectile forwardly of the wad in circumferentially space relation to the barrel.

* * * * *